United States Patent [19]

Higgins

[11] 4,358,975

[45] Nov. 16, 1982

[54] ROTARY CHISEL CUTTER

[75] Inventor: Bobby L. Higgins, Dallas, Tex.

[73] Assignee: Camsco, Inc., Richardson, Tex.

[21] Appl. No.: 152,776

[22] Filed: May 23, 1980

[51] Int. Cl.[3] ..... D06H 7/00; B26D 1/06

[52] U.S. Cl. ..... 83/56; 83/487; 83/471.2; 83/647

[58] Field of Search ..... 83/487, 746, 471.2, 83/483, 925 CC, 881, 886, 884, 56; 225/2, 96, 93, 96.5

[56] References Cited

U.S. PATENT DOCUMENTS

| | | | |
|---|---|---|---|
| 1,747,240 | 2/1930 | Haupt . | |
| 3,122,953 | 3/1964 | Atkeson | 83/487 X |
| 3,169,683 | 2/1965 | Pierce | 225/2 |
| 3,198,044 | 8/1965 | Clin | 83/487 X |
| 3,477,322 | 11/1969 | Gerber et al. | 83/71 |
| 3,522,753 | 8/1970 | Schmied | 83/471.2 |
| 3,533,320 | 10/1970 | Sederberg | 83/155 |
| 3,768,347 | 10/1973 | Wade et al. | 83/925 CC X |
| 3,772,949 | 11/1973 | Pavone et al. | 83/471.2 X |
| 3,780,607 | 12/1973 | Gerber | 83/49 |
| 3,830,122 | 8/1974 | Pearl | 83/169 |
| 4,156,378 | 5/1979 | Felten | 83/487 X |

*Primary Examiner*—Frank T. Yost

*Attorney, Agent, or Firm*—Richards, Harris & Medlock

[57] ABSTRACT

A cutting device (10) for cutting sheet material (14) is provided and comprises a circular cutting tool (40) including a blade (42) extending along the circumference thereof. A support structure (18) supports the sheet material (14). A cutting tool support (46) is provided for supporting the circular cutting tool (40) such that the circular cutting tool (40) freely rotates within the support (46) to thereby rotate on the surface of the sheet material (14) when the blade (42) contacts the sheet material (14). A drive mechanism (50) is interconnected to the cutting tool support (46) for imparting a vertical force to the cutting tool (40) for moving the blade into cutting engagement with the sheet material (14) to thereby cut the sheet material (14) with minimal vertical displacement of the circular cutting tool (40) during the cutting operation.

4 Claims, 4 Drawing Figures

ROTARY CHISEL CUTTER

TECHNICAL FIELD

This invention relates to material cutting machines, and more particularly to a rotary chisel cutting tool in which high impact forces are generated during cutting operations.

BACKGROUND ART

The use of automatic controlled equipment for cutting large quantities of pattern pieces from sheet material, such as fabrics from which wearing apparel, upholstery, structural material and other articles are made has necessitated the need for a cutting tool whose operation does not damage the cut material nor decrease the throughput of the automatic controlled equipment. Such cutting systems have employed mechanical cutters including knife and chisel type cutters operating in a reciprocating fashion. In cutting mechanisms using a knife type cutter, a reciprocating cutting blade is generally stroked in a direction normal to the sheet material to penetrate the material as the cutting edge or blade is advanced or guided along a predetermined cutting path by automatic controls. In such reciprocating cutters, during any cut cycle, the velocity vector of the cutting blade follows a sinusoidal path having two zero velocity points during the cycle. The cutter reaches zero velocity when it has been completely withdrawn from the sheet material and zero velocity when it impacts the sheet material supporting surface.

The occurrence of these two zero velocity points during any cycle typically causes excess material movement in the zero velocity region because of low cutting blade velocity and movement of the cutting machine support system. In cutting plastic materials and composite materials such as, for example, shoe material and fiberglass layered materials, the reciprocation rates of cutting tools produce sufficient heat in the material to cause localized heating, thereby causing fusion of adjacent plies of the layup of material being cut. As the cutting blade is drawn in and out of the sheet material, a drag force is created on the cutting blade producing an additional source of heat. Further, the reciprocating motion of the cutting blade causes displacement of the cut sheet material. Additionally, localized heating creates problems such as heat distortion and premature epoxy cure in fiberglass layered material being cut. The fusing of adjacent plies of the material, in addition to damaging the material, causes difficulty in separation of pattern pieces during later stages of the manufacturing process where the pieces are, for example, sewn or otherwise assembled with other pattern pieces.

A need has thus arisen for a cutting tool for use in a system for cutting plies of material, such as composite material, that prevents or substantially minimizes localized heating with no resulting part contamination. Furthermore, a need has arisen for a cutting tool that does not create fiber fringing, fiber separation and material displacement during the cutting operation. A need has further arisen for a cutting tool in which heat generation, during a cutting cycle, is minimized to thereby prevent premature epoxy cure and eliminate adhesion to the cutting tool due to epoxy tack.

DISCLOSURE OF THE INVENTION

In accordance with the present invention, a cutting tool is provided which substantially eliminates the problems heretofore associated with reciprocating cutting tools including localized heating of the material being cut and unacceptable quality cuts.

In accordance with the present invention, a cutting device for cutting sheet material is provided and comprises a circular cutting tool including a blade extending along the circumference thereof. A support structure supports the sheet material. A cutting tool support is provided for supporting the circular cutting tool, such that the circular cutting tool freely rotates within the support to thereby rotate on the surface of the sheet material when the blade contacts the sheet material. A drive mechanism is interconnected to the cutting tool support for imparting a vertical force to the cutting tool for moving the blade into cutting engagement with the sheet material to thereby cut the sheet material with minimal vertical displacement of the circular cutting tool during the cutting operation.

In accordance with another aspect of the present invention, in an automatically controlled instrument system in which continuous sheet material is spread on a supporting surface of a table and wherein an instrument is carried by a beam traversing the table for movement with respect to the surface of the table, a cutting instrument carried by the beam is provided. The cutting instrument includes a circular cutting tool having a cutting blade extending along the circumference thereof. Support structure is provided for supporting the circular cutting tool, such that the circular cutting tool freely rotates within the support structure to thereby rotate on the surface of the sheet material when the cutting blade contacts the sheet material. A drive mechanism is provided for imparting a vertical force to the circular cutting tool for moving the cutting blade into cutting engagement with the sheet material to thereby shear the sheet material with a minimal vertical displacement of the circular cutting tool to thereby minimize heat generation during the cutting operation.

In accordance with still another aspect of the present invention, a method of cutting sheet material supported on a surface with a circular cutting blade having a cutting edge includes rolling the circular cutting blade along the surface of the sheet material. The method further includes periodically impacting the circular cutting blade as the circular cutting blade rolls along the surface of the sheet material. The cutting edge of the circular cutting blade engages the support surface to thereby shear the sheet material, such that the support surface arrests the motion of the cutting blade. During the cutting operation, the vertical movement of the cutting blade minimizes the generation of heat.

BRIEF DESCRIPTION OF DRAWINGS

For a more complete understanding of the present invention and for further objects and advantages thereof, reference is now made to the following Detailed Description taken in conjunction with the accompanying Drawings in which.

DETAILED DESCRIPTION

Figure 1:
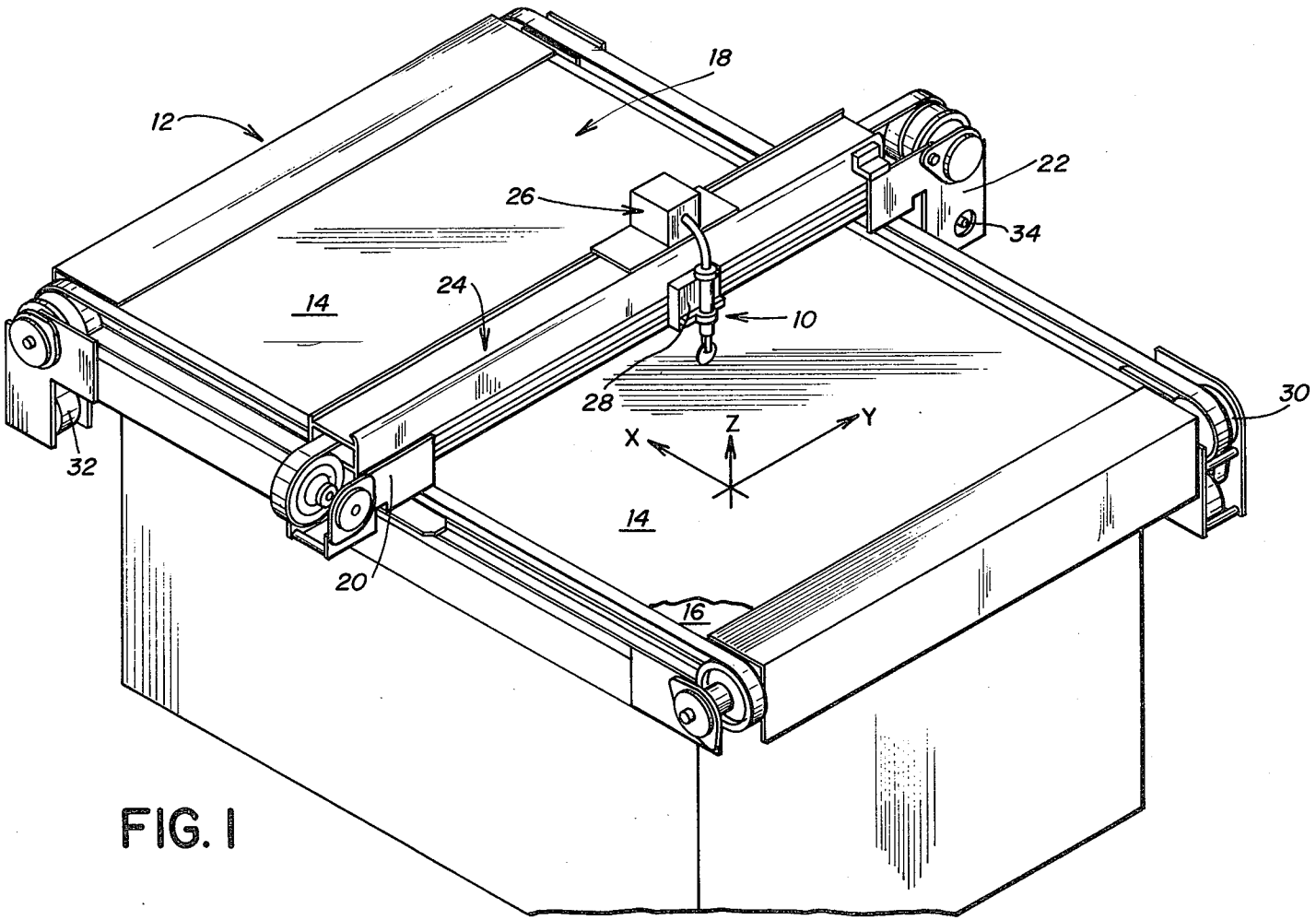
FIG. 1 is a perspective view of an automatically controlled instrument system utilizing the rotary chisel cutter of the present invention.

Referring to FIG. 1, the rotary chisel cutter of the present invention is illustrated and is generally identified by the numeral 10. Rotary chisel cutter 10 is illustrated for use in an automatically controlled instrument system generally identified by the numeral 12. Automatically controlled instrument system 12 may be utilized as illustrated in FIG. 1 to cut sheet material 14 supported on a surface 16 of a table generally identified by the numeral 18. Table 18 may comprise, for example, a vacuum or electrostatic hold-down table for supporting sheet material 14.

Automatically controlled instrument system 12 includes a pair of longitudinal carriages 20 and 22 which are mounted adjacent table 18. Carriages 20 and 22 support a beam generally identified by the numeral 24 which supports a lateral carriage generally identified by the numeral 26 for slidable movement therein. Carriage 26 moves in a direction transverse to movement of carriages 20 and 22 to cross table 18 in a direction perpendicular to movement of carriages 20 and 22 or in the Y coordinate direction relative to table 18. Carriages 20 and 22 simultaneously move beam 24 in the X coordinate direction along table 18. Rotary chisel cutter 10 is mounted to beam 24 using a bracket 28 for slidable movement along beam 24.

Positioning of rotary chisel cutter 10 is controlled through operation of drive motors 30, 32 and 34 which receive commands from a control computer (not shown) which contains information defining the path to be followed by rotary chisel cutter 10. As will be subsequently described, rotary chisel cutter 10 is periodically impacted to impart vertical movement in the Z coordinate direction to thereby cause rotary chisel cutter 10 to engage sheet material 14 to have its motion arrested by surface 16 of table 18 thereby shearing sheet material 14.

Figure 2:
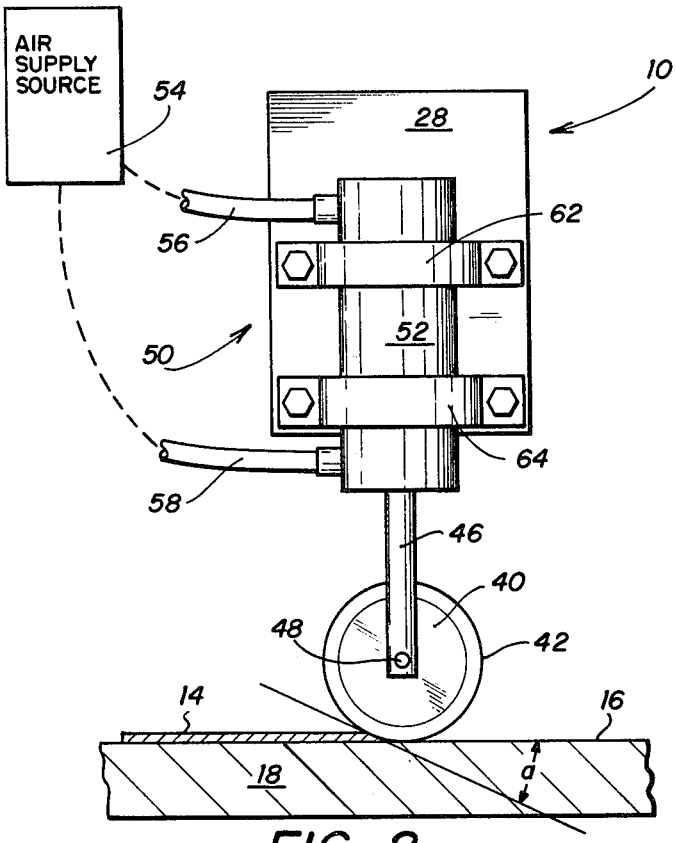
FIG. 2 is a side elevational view of the rotary chisel cutter shown in FIG. 1.
Figure 3:
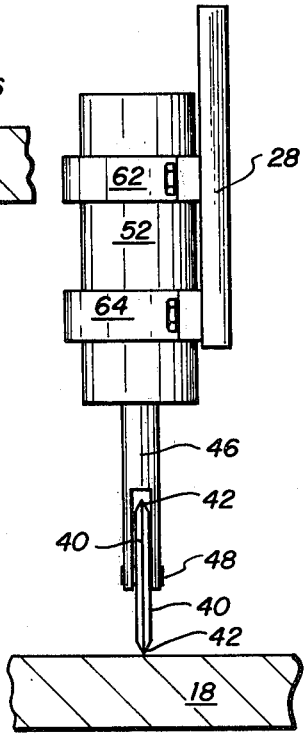
FIG. 3 is a front view of the rotary chisel cutter shown in FIG. 1.

Referring simultaneously to FIGS. 2 and 3, rotary chisel cutter 10 includes a circular cutting wheel 40 having a cutting edge 42. Circular cutting wheel 40 freely rotates within a support structure 46. Circular cutting wheel 40 is mounted to support structure 46 using a pin 48, such that any vertical movement of support structure 46 is imparted to circular cutting wheel 40.

Support structure 46 is interconnected to a drive system generally identified by the numeral 50. Drive system 50 may comprise, for example, a hydraulic cylinder 52 to impart a vertical force to support structure 46. Hydraulic cylinder 52 is actuated from an air supply source 54 through hoses 56 and 58 and is mounted to a bracket 28 (FIG. 1) using members 62 and 64. It is understood that hydraulic cylinder 52 is shown for illustrative purposes only and that any mechanisms by which an impact force can be generated and imparted to circular cutting wheel 40 can be utilized with the present invention. Air pressure sources, electrical or mechanical drive systems and the like can generally be utilized to generate an impact force which is periodically supplied to circular cutting wheel 40 to cause cutting edge 42 to engage sheet material 14. An important aspect of the present invention is that circular cutting wheel 40 is not rotary powered but is free to roll on the surface of sheet material 14 cutting is accomplished when cutting edge 42 is brought into cutting engagement with sheet material 14 due to short, high impact forces directed in the vertical direction to circular cutting wheel 40 which results in a minimal vertical displacement of circular cutting wheel 40 as cutting edge 42 engages sheet material 14. Cutting edge 42 enters sheet material 14 without retracting or reciprocating and is driven to surface 16 of table 18 as cutting edge 42 is withdrawn from sheet material 14.

The cutting process of engaging cutting edge 42 with sheet material 14 involves little work in that cutting edge 42 is not vertically drawn into sheet material 14 to engage surface 16 and then withdrawn from sheet material 14 as with conventional reciprocating cutters. Therefore, little heat is generated during the cutting operation. Since circular cutting wheel 40 is continuously rolling on the surface of sheet material 14, the zero velocity component of a conventional reciprocating cutter is eliminated thereby minimizing material movement and drag on cutting edge 42. The high impact force imparted to circular cutting wheel 40 cleanly shears sheet material 14 during the cutting operation to produce quality cuts that are smooth without fiber fraying and induced ply separation. Further, the operation of the present rotary chisel cutter 10 does not distort or cause successive movement of sheet material 14 during the cutting operation.

The diameter of circular cutting wheel 40 is selected such that the maximum tangent of the angle of contact between circular cutting wheel 40 and sheet material 14, indicated by the angle "a" in FIG. 2 is less than the coefficient of friction between sheet material 14 and surface 16 of table 18. This diameter assures that circular cutting wheel 40 can freely roll upon the surface of sheet material 14 without causing sheet material 14 to slide with respect to the surface 16 of table 18. The impact frequency of circular cutting wheel 40 is dependent upon the speed of rotary chisel cutter 10 and the nature of sheet material 14 to be cut. High impact frequencies of, for example, 100 to 150 impacts per second can be utilized with the present rotary chisel cutter 10.

Utilizing the present rotary chisel cutter 10, any desired shaped part can be cut from sheet material 14. As shown in FIG. 1, rotary chisel cutter 10 can be moved through operation of beam 24 in the positive and negative X and Y coordinate directions. Additionally, rotary chisel cutter 10 can be rotated about its vertical axis. In this fashion, curves and radii can be cut from sheet material 14. Additionally, parts cut from sheet material 14 having a very acute angle can be cut utilizing the present rotary chisel cutter 10 by reversing the direction of movement of rotary chisel cutter 10 with an intermediate rotation about the vertical axis of rotary chisel cutter 10. Rotary chisel cutter 10 can be utilized to cut multiply layers of sheet material 14 or single-ply materials held in place by the application of a vacuum to table 18.

Figure 4:
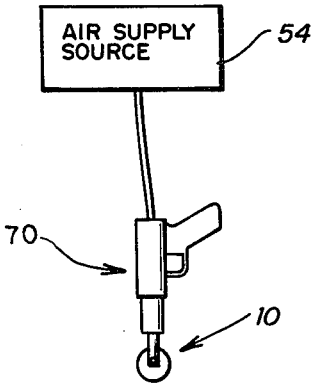
FIG. 4 is a side elevational view of the present rotary chisel cutter for handheld use.

FIG. 4 illustrates a second embodiment of the present rotary chisel cutter 10 mounted for operation in a hand tool generally identified by the numeral 70. Hand tool 70 can be grasped by an operator who thereby controls the movement of rotary chisel cutter 10 to cut parts from sheet material as an alternative to the automatic mode of operation as illustrated in FIG. 1 utilizing automatically controlled instrument system 12.

It therefore can be seen that the present invention utilizing a free rolling circular cutting wheel that is impacted with a high peak force to create a high stress to sever sheet material and provides for the elimination of localized heating within sheet material being cut heretofore present in conventional reciprocating cutting devices. Optimum control over the material being cut is thereby achieved plus the elimination of surface adhesion and friction since the average forces generated on the cutting wheel are low. The high peak forces are applied through a small distance thereby minimizing heat generated since the cutting blade is not retracted and reciprocated within the sheet material.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A cutting device for cutting sheet material cut on a support surface comprising:

a circular cutting tool including means for cutting extending along the circumference thereof;

support means for supporting said circular cutting tool, such that said circular cutting tool freely rotates within said support means to thereby roll on the surface of the sheet material when said cutting means contacts the sheet material; and impact means interconnected to said support means for generating and imparting an intermittent high impact force to said circular cutting tool in a direction normal to the axis of rotation of said circular cutting tool for moving said cutting means into intermittent cutting engagement with the sheet material such that said cutting means periodically impacts the sheet material support surface to thereby cut the sheet material with a minimal vertical displacement of said circular cutting tool to substantially minimize heat generation in the sheet material during the cutting operation.

2. The cutting device of claim 1 wherein said impact means comprises hydraulic pressure means.

3. The cutting device of claim 1 wherein the tangent of the angle of contact between said circular cutting tool and the sheet material is less than the coefficient of friction between the sheet material and the sheet material supporting surface.

4. A method of cutting sheet material cut on a support surface with a circular cutting blade having a cutting edge comprising:

rolling the circular cutting blade along the surface of the sheet material;

periodically impacting the circular cutting blade as the circular cutting blade rolls along the surface of the sheet material;

periodically engaging the cutting edge of the circular cutting blade with the support surface; and periodically shearing the sheet material, such that the support surface arrests the motion of the circular cutting blade when the circular cutting blade is periodically impacted thereby causing the circular cutting blade to engage the support surface.

* * * * *

UNITED STATES PATENT AND TRADEMARK OFFICE

CERTIFICATE OF CORRECTION

PATENT NO. : 4,358,975

DATED : November 16, 1982

INVENTOR(S) : Bobby L. Higgins

It is certified that error appears in the above-identified patent and that said Letters Patent are hereby corrected as shown below:

Column 3, line 64, change "material 14 cutting" to --material 14. Cutting--.

Signed and Sealed this

*Twenty-second* Day of *February 1983*

[SEAL]

*Attest:*

GERALD J. MOSSINGHOFF

*Attesting Officer*

*Commissioner of Patents and Trademarks*